US006086309A

United States Patent [19]

Mason et al.

[11] Patent Number: 6,086,309

[45] Date of Patent: Jul. 11, 2000

[54] METHOD AND APPARATUS FOR LIFTING CONTAINERS WITH ONE OR TWO HOOKS ON A REFUSE TRUCK

[75] Inventors: Coy DeLynn Mason, Midland; Carter Thurmond, San Antonio, both of Tex.

[73] Assignee: PAK MOR Company, San Antonio, Tex.

[21] Appl. No.: 09/085,709

[22] Filed: May 27, 1998

[51] Int. Cl.[7] ..... B65S 3/02

[52] U.S. Cl. ..... 414/409; 414/408

[58] Field of Search ..... 414/409, 408, 414/406, 420, 421, 810, 736, 723; 294/68.2, 68.3

[56] References Cited

U.S. PATENT DOCUMENTS

| | | | |
|---|---|---|---|
| 4,090,626 | 5/1978 | Ebeling et al. | 414/409 |
| 4,850,789 | 7/1989 | Zimmerman | 414/723 |
| 4,867,630 | 9/1989 | Johnson et al. | 414/408 |
| 5,044,863 | 9/1991 | LaBass et al. | 414/408 |
| 5,228,822 | 7/1993 | Schrader | 414/620 |
| 5,308,211 | 5/1994 | Bayne | 414/408 |
| 5,344,272 | 9/1994 | Nuyts | 414/408 |
| 5,651,654 | 7/1997 | Christenson | 414/408 |
| 5,807,056 | 9/1998 | Osborn et al. | 414/408 |

*Primary Examiner*—Gregory A. Morse

*Attorney, Agent, or Firm*—Fitch, Even, Tabin & Flannery

[57] ABSTRACT

A dumping system for various types of refuse containers is able to handle one hook or two hook containers. A simple adjustment to the lifting head moves the engaging pins into position to handle the appropriate container. In the one-hook configuration, one pin is shifted to an inoperative position.

7 Claims, 3 Drawing Sheets

Fig. 3
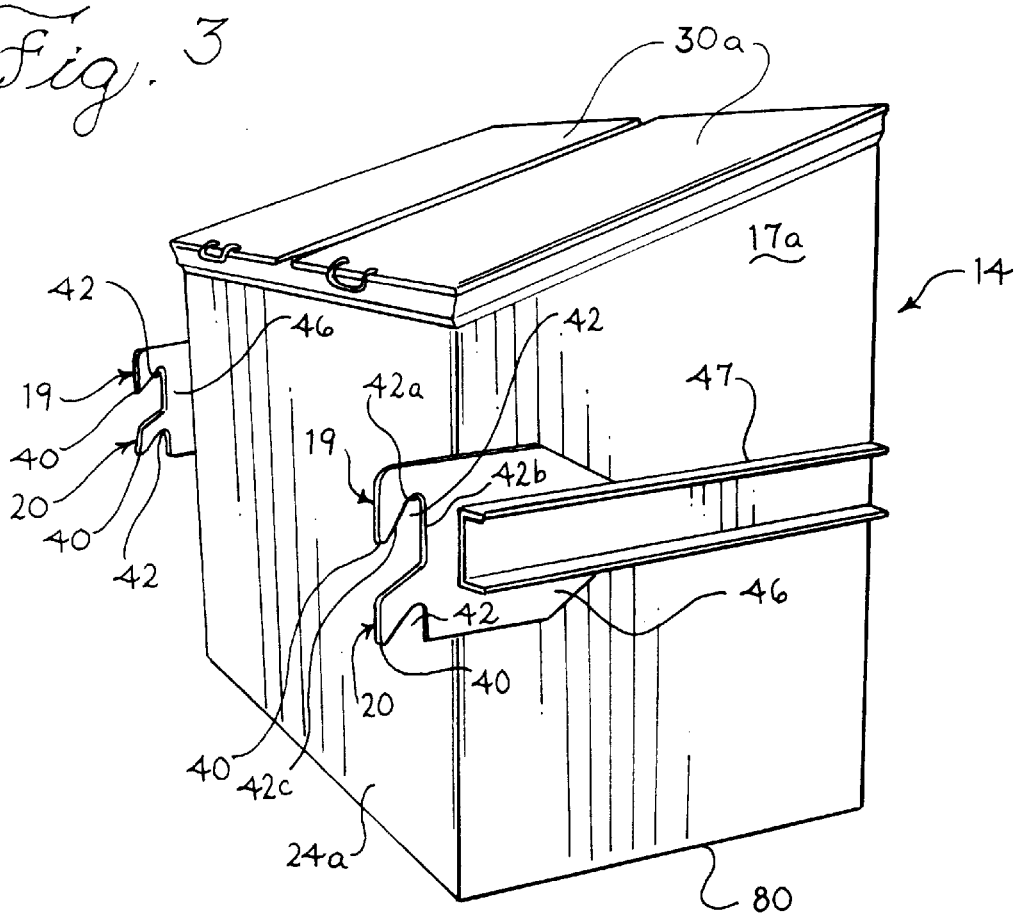
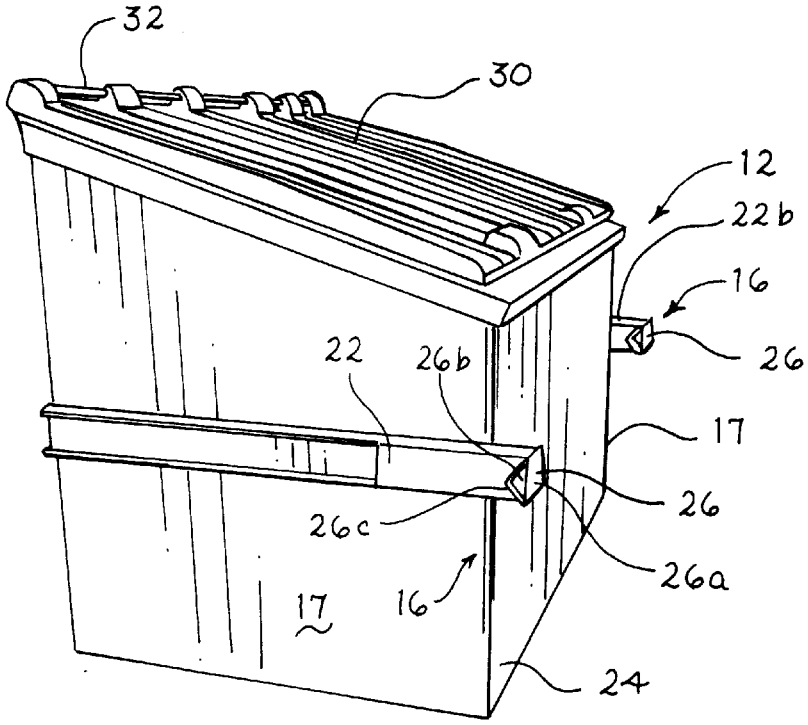
Fig. 4

METHOD AND APPARATUS FOR LIFTING CONTAINERS WITH ONE OR TWO HOOKS ON A REFUSE TRUCK

FIELD OF THE INVENTION

This invention relates to a method of and apparatus for lifting and emptying two different kinds of containers having single hooks or double hooks into a interior chamber of a refuse or garbage truck.

BACKGROUND OF THE INVENTION

In many instances, the refuse trucks encounter different kinds of refuse containers, and it is desirable that these different containers be lifted by the same lifting mechanism on the refuse truck upwardly towards the top of the truck and then inverted to empty the contents. Then, the container is rotated back and carried down to the ground level where the truck lift mechanism is automatically disconnected from the container. Usually, to connect the lifting mechanism on the truck to a container having hooks, the lifting mechanism is brought into alignment and hooked onto the container hooks. Upward traveling heads on the lifting mechanism slide along tracks on opposite sides of the truck body and are raised by the truck operator to an upper emptying position. Then the emptied container is lowered by the heads and then the container is unhooked from the lifting mechanism.

Typically, the single hook containers have T-shaped hooks projecting from the sides of container adjacent the center of the vertical sidewalls of the container. The T-shaped hooks are straight, horizontal bars projecting forwardly of a front sidewall of the container and have an integral cross bar extending transversely across a distal, free end of the horizontal bar. The truck lifting head has a slot to receive the horizontal bar and a plate to be positioned behind the cross bar. Usually, the containers have a sloped, top cover that is pivotally mounted for swinging from a closed position to an open position when the container is inverted by the lifting mechanism. A pair of clamps carried by the head swing into position to clamp the hooks from disengagement with the head as the container is pivoted down to empty its contents and is pivoted up to return to its normal, upright position.

Typically, the double hook container has a pair of upper and lower hooks projecting forwardly from each of the vertical sidewalls of the container beyond the front wall of the container. The hooks have downwardly pointed ends with interior, upwardly-extending slots leading to a vertical wall defining the interior side of the slots. The truck head has a pair of members, such as pins, that are raised and cam into the downwardly-opening, pair of slots. With upper and lower pins inserted into the upper and lower slots of the upper and lower hooks, the heads will travel upwardly along curved tracks to lift the double hook container and then swing and invert the container to empty its contents into the truck's interior chamber. The clamping mechanism on the heads holds the pins in the hooks as the container pivots and the slots face upwardly into the container emptying position. After emptying and lowering the container, the engaged pins on the truck are lowered from the hook slots and the truck moves away from the container to dislodge from the container.

The above-described hooks and containers as well as the conventional heads are only described as being exemplary of the hooks and heads, which may differ from that described and illustrated herein. This invention is not limited to the described or illustrated hooked containers or the heads and left mechanisms, but it is intended to cover various kinds of hooked containers and lifting mechanisms.

It will be appreciated that handling of these large containers, which may have heavy refuse therein, and which are impacted by the truck require relatively strong and rugged parts that are being impacted and subject to heavy loads. Thus, mechanisms or parts that are employed to allow conversion between single hook containers and double hook containers must be sufficiently strong to withstand rough handling conditions and high loads. Moreover, the conversion pieces to equip a conventional lift mechanism capable of handling only one style of container to lift both styles of containers should be low cost. The conversion should be simple so that it can be done by one person, as there may be only one driver on the refuse truck. Also, the conversion should be done relatively quickly so that refuse collection is not greatly delayed by converting back and forth between single and double hook-up containers. Thus, there is a need for a new and improved head lift mechanism for use with either single or double hook containers.

SUMMARY OF THE INVENTION

In accordance with the present invention, a lift and dump truck mechanism for lifting hooked refuse containers is provided with the ability to lift and dump containers that have single or double hooks by a simple adjustment to the lifting heads of the container lifting mechanism. This is achieved by having the lifting head provided with a shiftable pocket which, when it is in its first operative position, engages the single hooks for lifting and dumping the single hook container and by using a pair of pins which, when the pocket is shifted to its inoperative position, are able to hook the double hooks on the double hook container for lifting and dumping the double container. The preferred head is provided with a second pin, which is shifted from an operative position to engage one of the double hooks to an inoperative position where it does not interfere with the single hook connection. Herein, the second pin is shifted to its operative position by being inserted into the head and is shifted to its inoperative position by being removed from the head.

BRIEF DESCRIPTION OF THE DRAWINGS

FIG. 3 is a view of a double hook container to be lifted by the present invention;

FIG. 4 is a view of a single hook container to be lifted by the present invention;

DETAILED DESCRIPTION OF THE PREFERRED EMBODIMENT

Figure 1:
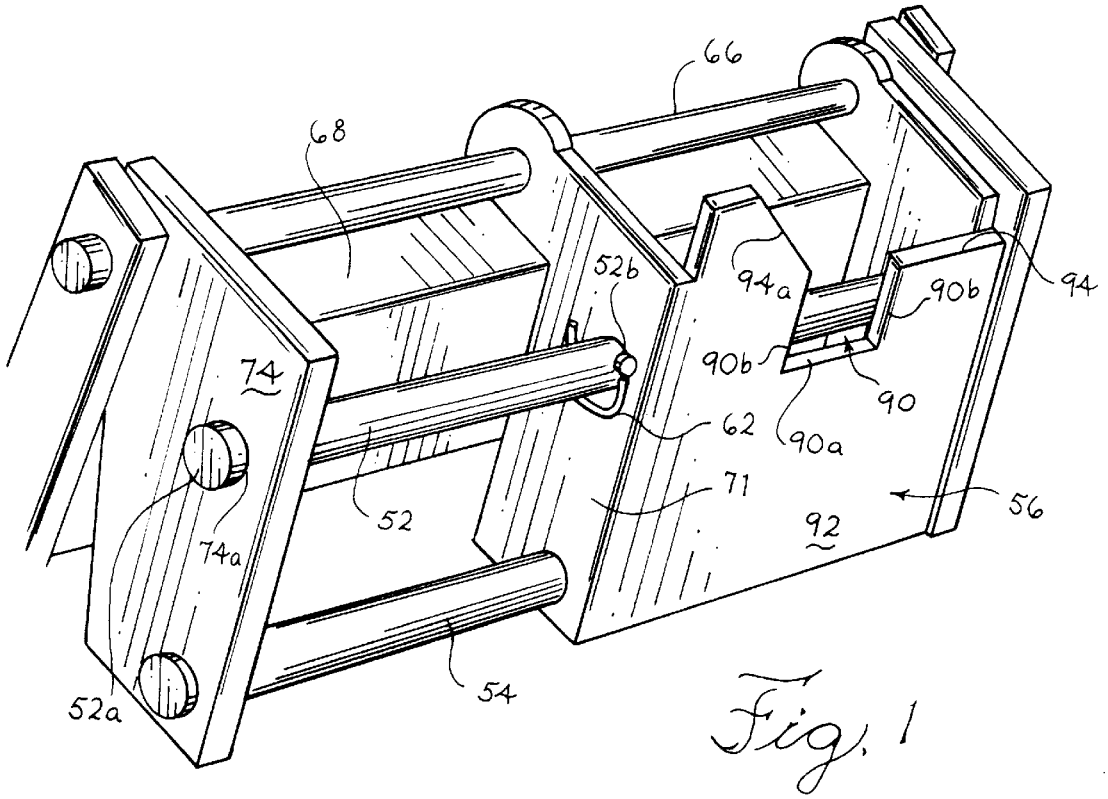
FIG. 1 is a perspective view of a lifting head or carriage for lifting either a single hook or a double hook container.

As shown in the drawings, for purposes of illustration, the invention is embodied in an apparatus 10 for lifting and emptying trash or garbage containers 12 and 14 (FIGS. 3 and 4) which have respectively different hooks thereon for connection to the lifting apparatus. The single hook container 12 has a single hook 16 projecting forwardly from about the center of a pair of vertical sidewalls 17 on the container. The double hook container 14 has a pair of hooks 19 and 20 projecting forwardly from about the center of a pair of vertical sidewalls 17*a* on the double hook container.

The illustrated single hook container 12 has a T-shaped, single hook 16 which is formed with a horizontal bar 22 welded or otherwise secured to the container outer sidewall 17. An outer, distal end 22*b* on the bar which projects forwardly in front of a vertical front wall 24 of the container. A cross bar 26 is attached to the outer distal end 22*b* and extends transversely of the horizontal bar 22. The cross bar preferably has a forward flat, vertical plate wall 26*a* and may have a pair of inclined, rear walls 26*b* and 26*c* to form a triangular cross section for the cross bar 26 of the single hook.

The illustrated, single hook container 15 is formed with a pivoted or hinged cover or lid 30 with a pivot or hinge pin 32 at a top rear corner of the container. Usually, the lid is sloped downwardly from an upper pivoted end to a lower front end located at the front wall 24 of the container 12. The single hooks are identical and cooperate with the automatic lifting and emptying apparatus 10 to lift the container for travel upwardly along a curved path as defined by a pair of slide rails 34 on the rear side of a refuse truck 36 to an emptying position at which the container 12 is rotated to an inverted state where the container contents force the cover 30 to pivot open and the contents drop into the interior of the trucks. The lifting mechanism then reverses its travel and the container swings back to its normal, upright position with the cover swinging back to its closed position.

The illustrated, double hook container 14 has an upper hook 19 and a lower hook 20 projecting forwardly from sidewall 17*a* of the container 14 beyond front wall 24*a* of the container. Herein, the upper and lower hooks each have a downwardly, pointed end 40 which defines an outer side of a pin receiving slot 42. The slot 42 is defined by a curved top wall 42*a* and an inner vertical side 42*b*. The slot also has an inclined, outer side 42*c* and the hook end 40. This inclined wall 42*c* serves to guide and cam the pins on the lifting mechanism to seat in the curved, top wall 42*a*. Herein, the hooks 19 and 20 are formed as cut-outs in a single, flat vertical hook plate 46 that is welded to the outer side of two vertical, container sidewall 17*a*. A reinforcing channel 47 is also welded across the vertical hook plate and to the container wall to retain and to reinforce the hook plate 46 and the container sidewall 17*a*. The double hook container is provided with a pair of pivoted top covers 30*a* that swing open to dump the contents of the container.

The above-described single hook and double hook containers 12 and 14 are often located on the same truck route and it is desirable that a truck operator be able to lift and to empty either of these containers and to switch back and forth quickly. Because the trucks bump against the containers and because the containers may have very heavy loads therein, it is important that conversion pieces added to the lifting apparatus be strong and relatively maintenance free under such demanding conditions. Also, the conversion pieces are preferably added to existing, proven lifting heads 50 that are proven in long use in the field. The conventional lifting head and connector to the truck lifting arms is that used in a double hook lifting mechanism of Pak MOR of San Antonio, Tex., which need not be described herein in detail.

In accordance with the present invention, the hood engaging heads 50 on the truck lifting mechanism are constructed to have either a pair of pins or members 52 and 54 in operative position to couple to the double hooks 19 and 20 (FIG. 3) on the double hook container 14 or a pocket 56 in the operative position (FIG. 2) to couple to the single hooks 26 on the single hook container 12. The operative position of the pocket 56 is when it is positioned in its outer or left hand position of FIG. 2 and the inoperative position is when the pocket is in the right hand position of FIG. 1. Preferably, the pocket is secured in either of its operative positions by a retainer such as removable retention pins 60 and 62 (FIG. 2).

Figure 2:
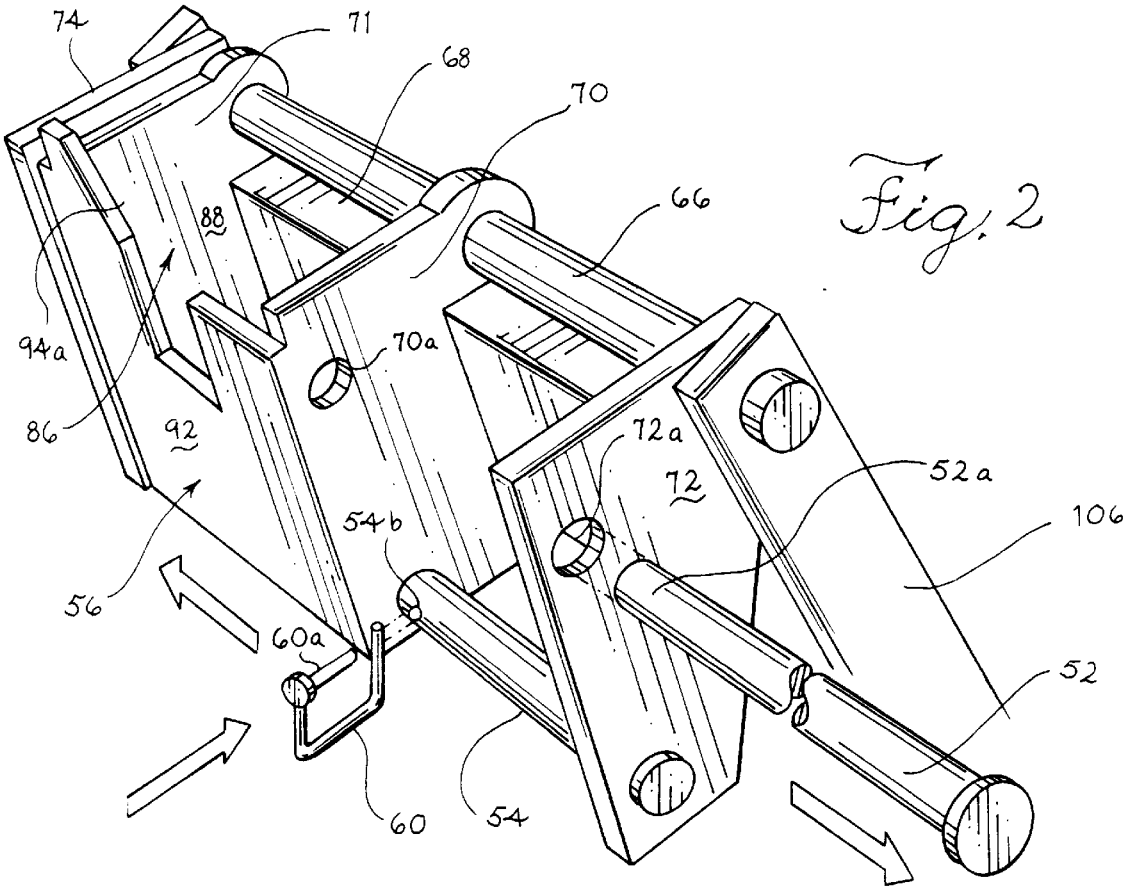
FIG. 2 is a perspective view of the lifting head or carriage of FIG. 1 configured to lift a single hook container.

When converting the heads 50 between the single hook position (FIG. 2) and the double hook position (FIG. 1), the operator of the lift mechanism will remove the retainer pin 60 from a hole 62 in the lower pin 54 and slide the pocket along the lower pin 54, an upper pivot shaft 66, and a back channel 68 to the position in FIG. 1 where vertical sidewall 70 of the pocket is adjacent the right hand head, vertical wall 72. Then the second, upper pin 52, which had been previously removed, is reinserted by sliding an end 52*a* through an aperture 72*a* in the vertical wall 72 and an adjacent aperture 701 in pocket wall 70 until the upper pin 52 has a projection through an aperture 74*a* in a vertical head wall 74. The retainer 62 is inserted through a hole 52*b* in the upper pin and prevents adjacent, vertical sidewall 71 of the pocket 56 from sliding along the pins 52 and 54 to the left hand operative position.

When the pocket 56 is in the inoperative position (FIG. 1), the pins 52 and 54 are in the operative position to be inserted into the slots 42 of the respective upper and lower hooks 19, 20. The pins are brought by the backward movement of the truck into alignment with the upper and lower hooks and into alignment with the slots 42. Then, the pins 52 and 54 and heads 50 are raised to move upwardly. The pins may hit inclined cam surfaces 42*c* and slide therealong into the top rounded portion 42*a* of the respective hooks 19 and 20. Thus, the double pin container 14 will be hooked to the two heads on opposite sides of the truck for lifting the container. After emptying the container 14, a bottom wall 80 of the container is brought down to rest on the ground and the pins 52 and 54 are lowered further from the slots 42 and shifted horizontally away from the container.

If the next container is a single hook container 12, the pockets will be shifted to the operative position by sliding it to the left along pins 52 and 54 after removal of the retainer 52*b* until pocket wall 71 abuts the left head wall 74. Then, the retainer 60 is secured to the lower pin 54 by inserting retainer shaft 60*a* through aperture 54*b* in the pin 54 with the retainer shaft being located adjacent the pocket wall 70 to prevent the pocket from sliding to the right in FIG. 2. Also, the upper pin 52 is slid to right, as shown by the directional arrow in FIG. 2, to remove it from apertures 70*a* and 72*a*. The extraction of the upper pin 52 leaves an open top 86 of the pocket to receive a single hook 16 therein. To hook the container 14 to the pair of pockets 56, the pockets 56 are brought into alignment with the respective hooks 16 and then the heads are raised so that the cross arms 26 are positioned within a hollow chamber 88 of the pocket. The lower portion of the horizontal arm 22 of the single hook 16 is positioned within a notch 90 defined by a horizontal edge 90*a* defined by a horizontal edge 90*a* and a pair of spaced, vertical edges 90*b* in a front plate 92 of the pocket 56. The notch extends down into the front plate 92 from an upper end wall 94 on the plate 92.

To assist in camming and entry of the single hook 16 into the hollow chamber 88, the upper end wall 94 is formed with an inclined, camming portion 94*a* at the left hand, upper portion of the plate 92. That is, the truck will position the pockets 56 with the hollow chambers 88 below and aligned with the single hooks 16 and raise the heads and pockets 56 to insert the horizontal arm 22 into the notches 90 with the single hook cross arms being positioned in the hollow chambers 88 of the pockets. The pockets are raised to abut lower side of the horizontal arms 22 against bottom edge walls 90*a* of the notches 90. The cross arms 26 will abut the inner surface of the plate 92 when the container is being lifted.

Figure 5:
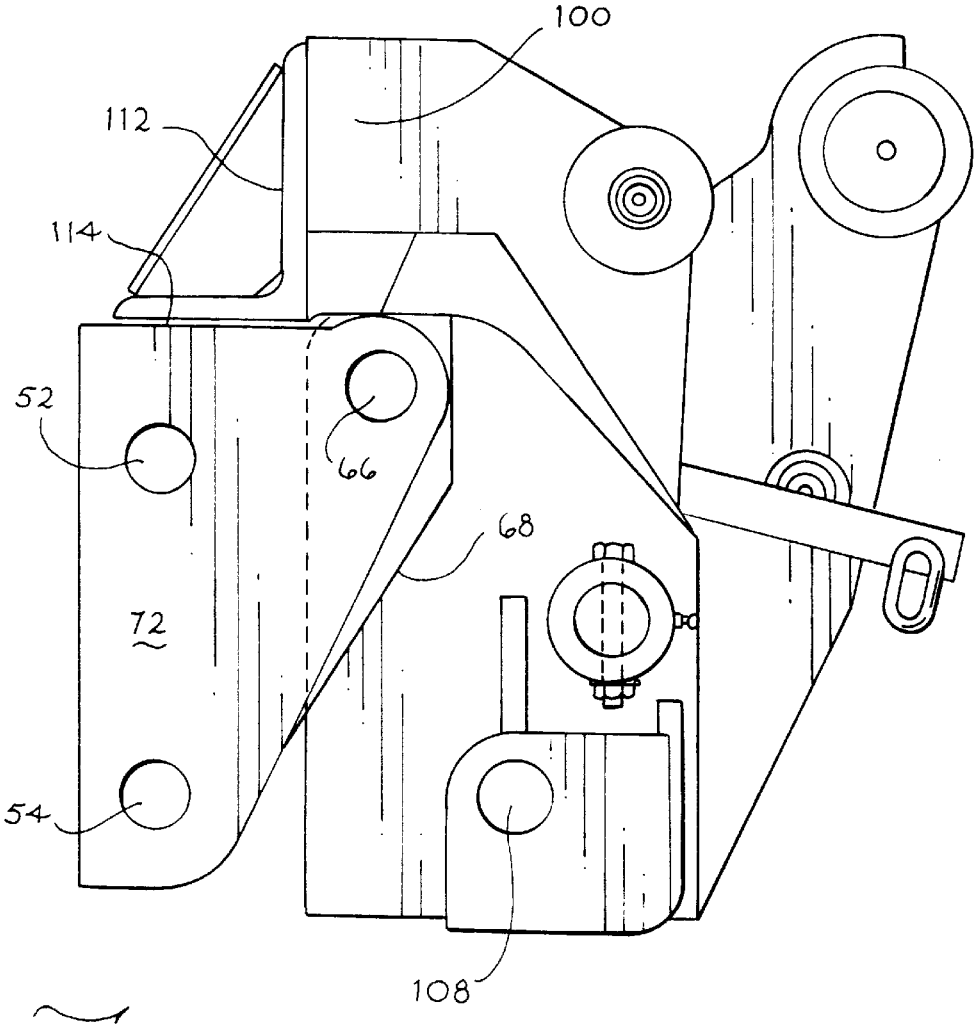
FIG. 5 is a side elevational view of the lifting head with a clamp for clamping the containers to the head when the container is inverted to dump its contents.
Figure 6:
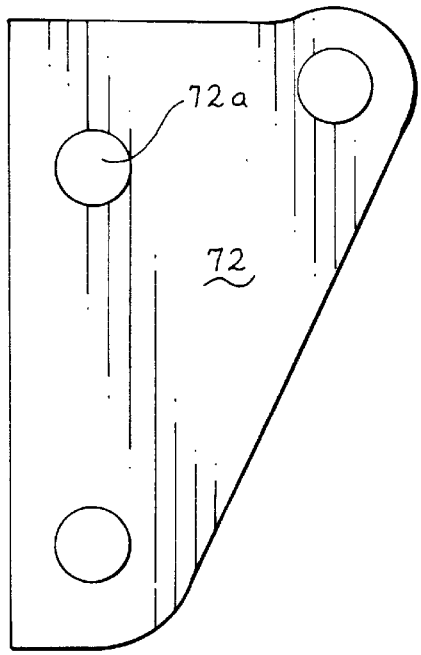
FIG. 6 is a side view of a plate of the lifting head.

A clamp 100 is pivotally mounted at pivot axis 102 of the head which has a pin connected to a lower arm plate 106 that is operatively connected to a truck lifting arm (not shown) at a pivot shaft 108 (FIG. 5). The clamp has an upper head 112 that pivots over the top of the hooks, as shown in FIG. 5, with a lower wall preventing the outward movement of the single or double hooks from the pocket when the pocket is inverted to change the container contents.

It will be appreciated that although various aspects of the invention have been described with respect to specific embodiments, alternatives and modifications will be apparent from the present disclosure, which are within the spirit and scope of the present invention as set forth in the following claims.

What is claimed is:

1. A lifting and dumping mechanism for use on a lift refuse truck for lifting and dumping either one hook or double hook containers, the lifting and dumping mechanism comprising:

a pair of power operated heads for traveling along the guide tracks from a lower position to hook onto the containers to an upper position where the containers are pivoted to dump the container contents into a chamber in the truck;

a selectively positionable pocket on each of the heads for connection to the single hook container for carrying the single hook container between the upper and lower positions of head;

at least one selectively positionable upper pin on each head for positioning in an operative position on the head for connection to an upper hook of the double hooks on the double hook container;

a hollow chamber in each pocket into which is inserted either a single hook or a double hook for a container;

the upper pin being in the hollow chamber of the pocket for cooperation with an upper hook on the double hook container;

lower pins in the hollow chambers of the pockets for cooperation with lower hooks on the double hook container;

the upper pins being selectively positioned in the upper pockets for removal from the chamber to allow insertion of a single hook of a single hook container into the hollow chamber;

a front plate on each of the pockets having a vertical slot therein to receive a shank of a single hook with a crosswise end of the single hook positioned in the hollow chamber and engaging the interior side of the front plate; and the front plates being moved to an inoperative position to allow insertion of the double hooks for lifting engagement with the upper and lower pins.

2. A lifting and dumping mechanism in accordance with claim 1 wherein the pocket comprises a slanted camming edge on the vertical slot of the front plate to cam a shank of the single hook, a crosswise end of the hook being positioned in a hollow chamber of the pocket and engaging an interior side of the vertical, front plate.

3. A lifting and dumping mechanism in accordance with claim 1 wherein the removable pin slides laterally outwardly from the inoperative position into the operative position to hook the double hook container.

4. A lifting and dumping mechanism in accordance with claim 1 wherein:

a pair of spaced sidewalls on each pocket carry the front plate of the pocket;

the spaced sidewalls having holes therein through which project the upper and lower pins to allow lateral sliding of the front plate between its operative and inoperative positions.

5. A lifting and dumping mechanism of claim 4 wherein:

an upper pivot shaft is provided for pivotally mounting the pocket;

the spaced sidewalls being slidably mounted on the upper pivot shaft to shift the front plate between its operative and inoperative positions.

6. A lifting and dumping mechanism in accordance with claim 4 wherein a retainer retains the upper pin in operative position against removal.

7. A lifting and dumping mechanism in accordance with claim 6 wherein the retainer comprises a manually removable retainer pin for connection to the upper pin to prevent its lateral removal from the hollow chamber in the pocket when lifting double hook containers.

* * * * *